US007790664B2

(12) United States Patent
Harrington et al.

(10) Patent No.: US 7,790,664 B2
(45) Date of Patent: Sep. 7, 2010

(54) METHODS FOR MAKING A NIL-PHOSPHATE LIQUID AUTOMATIC DISHWASHING COMPOSITION

(75) Inventors: Roy Jerome Harrington, Liberty Township, OH (US); Ramona Quintanilla Fahlbusch, West Chester, OH (US); Patti Jean Kellett, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1 day.

(21) Appl. No.: 12/258,524

(22) Filed: Oct. 27, 2008

(65) Prior Publication Data

US 2010/0105597 A1 Apr. 29, 2010

(51) Int. Cl.

| | |
|---|---|
| ***C11D 1/66*** | (2006.01) |
| ***C11D 3/37*** | (2006.01) |
| ***C11D 3/10*** | (2006.01) |
| ***C11D 3/08*** | (2006.01) |
| ***B08B 3/04*** | (2006.01) |

(52) U.S. Cl. ..... 510/220; 510/230; 510/232; 510/421; 510/466; 510/475; 510/509; 134/25.2; 134/25.3

(58) Field of Classification Search ..... 510/220, 510/230, 232, 421, 466, 475, 509; 134/25.2, 134/25.3

See application file for complete search history.

(56) References Cited

U.S. PATENT DOCUMENTS

| | | | | |
|---|---|---|---|---|
| 3,128,287 | A | | 4/1964 | Berg et al. |
| 3,159,581 | A | | 12/1964 | Diehl |
| 3,213,030 | A | | 10/1965 | Diehl |
| 3,308,067 | A | | 3/1967 | Diehl |
| 3,400,148 | A | | 9/1968 | Quimby |
| 3,422,021 | A | | 1/1969 | Roy |
| 3,422,137 | A | | 1/1969 | Quimby |
| 3,629,121 | A | | 12/1971 | Eldib |
| 3,635,830 | A | | 1/1972 | Lamberti et al. |
| 3,715,184 | A | | 2/1973 | Kuhling et al. |
| 3,835,163 | A | | 9/1974 | Rapko |
| 3,923,379 | A | | 12/1975 | Kumada |
| 3,929,678 | A | | 12/1975 | Laughlin et al. |
| 3,985,669 | A | | 10/1976 | Krummel et al. |
| 4,101,457 | A | | 7/1978 | Place et al. |
| 4,102,903 | A | | 7/1978 | Crutchfield et al. |
| 4,120,874 | A | | 10/1978 | Crutchfield et al. |
| 4,141,841 | A | | 2/1979 | McDanald |
| 4,142,480 | A | | 3/1979 | Schwandt et al. |
| 4,144,226 | A | | 3/1979 | Crutchfield et al. |
| 4,158,635 | A | | 6/1979 | Crutchfield et al. |
| 4,174,291 | A | | 11/1979 | Benjamin et al. |
| 4,223,163 | A | | 9/1980 | Guillofy |
| 4,228,042 | A | | 10/1980 | Letton |
| 4,239,660 | A | | 12/1980 | Kingry |
| 4,246,612 | A | | 1/1981 | Berry et al. |
| 4,259,217 | A | | 3/1981 | Murphy |
| 4,260,529 | A | | 4/1981 | Letton |
| 4,530,766 | A | | 7/1985 | Hann et al. |
| 4,536,314 | A | | 8/1985 | Hardy et al. |
| 4,566,984 | A | | 1/1986 | Bush |
| 4,605,509 | A | | 8/1986 | Corkill et al. |
| 4,659,802 | A | | 4/1987 | Rubingh et al. |
| 4,663,071 | A | | 5/1987 | Bush et al. |
| 4,810,410 | A | | 3/1989 | Diakun et al. |
| 5,084,535 | A | | 1/1992 | Hennig et al. |
| 5,114,611 | A | | 5/1992 | Van Kralingen et al. |
| 5,227,084 | A | | 7/1993 | Martens et al. |
| 5,358,519 | A | | 10/1994 | Grandjean |
| 5,559,089 | A | | 9/1996 | Hartman et al. |
| 5,602,092 | A | * | 2/1997 | Repinec et al. ..... 510/434 |
| 5,691,292 | A | | 11/1997 | Marshall et al. |
| 5,698,046 | A | | 12/1997 | St. Laurent et al. |
| 5,705,464 | A | | 1/1998 | Scheper et al. |
| 5,798,326 | A | | 8/1998 | Goldstein et al. |
| 5,804,542 | A | | 9/1998 | Scheper et al. |
| 5,804,544 | A | | 9/1998 | Powell et al. |
| 5,962,386 | A | | 10/1999 | Scheper et al. |
| 5,967,157 | A | | 10/1999 | Chatterjee et al. |
| 5,972,040 | A | | 10/1999 | Moss et al. |
| 6,020,294 | A | | 2/2000 | Getty et al. |
| 6,113,655 | A | | 9/2000 | Tsunetsugu et al. |
| 6,119,705 | A | | 9/2000 | Getty et al. |
| 6,143,707 | A | | 11/2000 | Trinh |
| 6,326,341 | B1 | | 12/2001 | Chatterjee et al. |
| 6,593,287 | B1 | | 7/2003 | Jordan et al. |
| 6,602,837 | B1 | | 8/2003 | Patel |

FOREIGN PATENT DOCUMENTS

| | | | |
|---|---|---|---|
| EP | 0066915 | B1 | 11/1987 |
| EP | 0332294 | B1 | 8/1992 |
| EP | 0200263 | B2 | 10/1995 |
| EP | 0482807 | B1 | 12/1995 |
| EP | 0414549 | B2 | 8/2004 |
| GB | 864798 | A | 4/1961 |
| WO | WO 93/08876 | | 5/1993 |
| WO | WO 95/02665 | A1 | 1/1995 |

* cited by examiner

*Primary Examiner*—Brian P Mruk
(74) *Attorney, Agent, or Firm*—Idris N. McKelvey

(57) ABSTRACT

A method of making a liquid ADW detergent composition comprising the successive steps of: a) forming a solution premix comprising: i) water; ii) an alkali metal carbonate; iii) a dispersant polymer; and b) adding an alkali metal silicate to said solution premix wherein said composition comprises a low-foaming nonionic surfactant and wherein said composition is substantially free of a phosphate builder.

11 Claims, No Drawings

METHODS FOR MAKING A NIL-PHOSPHATE LIQUID AUTOMATIC DISHWASHING COMPOSITION

FIELD OF THE INVENTION

The present invention relates to methods for making a liquid automatic dish washing detergent composition, which provides anti-corrosive benefits, and which contains little or no phosphate.

BACKGROUND

Sodium polyphosphates have been used as the builder of choice in previous aqueous cleaning solutions, but because of the increased use of liquid detergents, where sodium tripolyphosphate has a limited solubility, and increased environmental concerns on the use of phosphorous containing builders, alternative compositions have been investigated. However, with the decrease in phosphate use, performance of the cleaners has also decreased.

Attempts have been made to replace sodium tripolyphosphate with sodium carbonate. Sodium carbonate has been found to effectively clean soil from dishes when combined with sodium silicate, which prevents corrosion of glass and metal during the wash. It has been found that the introduction of sodium silicate results in the formation of magnesium silicate, due to free magnesium which is present in household water supplies. The magnesium silicate forms thin films over substrates in the wash, the film being most readily visible on metal and glass. Over time, repeated deposition of magnesium silicate film on metal results in the development of a blue coloration of the metal substrates. In order to prevent coloration of metal dishware, and the metal components of automatic dishwashing machines, sodium silicate levels must be minimized in the liquid composition. However, some level of silicate must be present in order to prevent corrosion of glass and metal. Previous attempts to minimize the silicate level in nil-phosphate compositions have resulted in liquid compositions which exhibit poor viscosity and overall rheological profiles. It is well known that achieving suitable rheological parameters is important to signal to consumers that the composition provides sufficient cleaning of dishware.

Based on the foregoing, there is a need for a liquid automatic dish washing composition, which is substantially free of phosphate, and which minimizes visible filming of metal substrates during the wash, while maintaining desirable rheological attributes.

SUMMARY OF THE INVENTION

The present invention relates to a liquid detergent composition consisting essentially of:

a) an alkali metal carbonate; b) a dispersant polymer; c) from about 0.5 wt. % to about 3.0 wt. % of an alkali metal silicate; and d) a low foaming non-ionic surfactant, wherein said composition exhibits a viscosity of from about 5,000 Cps-40,000 Cps.

The present invention also relates to a method of making a liquid detergent composition comprising the successive steps of: a) forming a solution premix comprising: i) water; ii) an alkali metal carbonate; iii) a dispersant polymer; and b) adding an alkali metal silicate to said solution premix.

DETAILED DESCRIPTION

While the specification concludes with claims that particularly point out and distinctly claim the invention, it is believed the present invention will be better understood from the following description.

All percentages, parts and ratios are based upon the total weight of the compositions of the present invention, unless otherwise specified. All such weights as they pertain to listed ingredients are based on the active level and, therefore, do not include solvents or by-products that may be included in commercially available materials, unless otherwise specified. The term "weight percent" may be denoted as "wt. %" herein.

All molecular weights as used herein are weight average molecular weights expressed as grams/mole, unless otherwise specified.

The terms, "nil-phosphate", or "substantially free of a phosphate builder", as used herein, means that the liquid automatic dish washing compositions comprise very low levels of phosphate, and preferably no phosphate. If phosphate is present in the compositions, it is preferred that the phosphate is not comprised as a builder.

The present invention encompasses a method whereby nil-phosphate automatic dish washing (ADW) components may be combined in such a fashion as to achieve desireable rheological traits, as well as preserving stability and preventing visible filming of metal substrates in the wash. The method of the present invention results in a liquid detergent composition which comprises essentially of an alkali metal carbonate; a dispersant polymer; from about 0.5 wt. % to about 3.0 wt. % of an alkali metal silicate; and a low-foaming non-ionic surfactant. Of course, other optional ingredients may be included.

Rheology

The detergent compositions utilized in the method of the present invention must be liquid in nature. As used herein, the term "liquid" includes liquids, viscous liquids, slurries, foams, pastes, and gels. The particular form which a detergent composition takes may be dictated, at least in part, by the use for which the composition is intended. For example, if a detergent composition is formulated for use in an automatic dishwasher, it is most advantageously formulated as a viscous liquid, paste, or gel, such that it will not leak out of the detergent dispenser in the automatic dishwasher, when it is used.

Consumers experience thickness at two distinct times during their use of a gel automatic detergent composition. First, as a consumer dispenses the product from the bottle the fluid's resistance to flow through the bottle's opening will influence their perception of thickness. A low resistance will be perceived as thin and watery, while a high resistance will be perceived as too thick. This resistance to flow is a function of the fluid's viscosity at the shear rate applied to the fluid during dispensing by the consumer. A representative shear rate during dispensing may be 150 inverse seconds.

A second impression of thickness will be formed by the consumer upon inspection of the product as it appears in the dishwasher's dispensing cup. If the fluid mounds as it is dispensed and retains some of its shape in the cup, the consumer will be accepting of the product. However, if the fluid readily forms a flat surface in the cup, much like water would, the consumer will find this product to be thin and reject the gel detergent as having diminished cleaning performance. The yield stress of the fluid can be correlated with this particular fluid behavior.

A third point, while not necessarily observable by the consumer at the time of dispensing occurs when the machine door is closed. The product must have a high enough viscosity to resist flow out of the closed main wash dispensing cup. The force of gravity will tend to pull the gel into the machine prematurely so that the gel automatic detergent composition would not be available during the main wash cycle; therefore, the consumer would experience a diminished performance from the gel detergent. A representative shear rate for the force of gravity on a fluid through a closed cup may be 1 inverse second.

Viscosity is a measure of the internal resistance to flow exhibited by a fluid in terms of the ratio of the shear stress to the shear rate. The yield value is an indication of the shear stress at which the gel strength is exceeded and flow is initiated.

A preferred method herein for characterizing a fluid's rheology is by using the Advanced Rheometer AR 2000 that employs Rheology Advantage software to control the rheometer and collect the data generated by the rheometer as it measures a fluid's responses to various forces applied to the fluid.

The data collected by the rheometer may then be evaluated using TA Data Analysis software provided by TA Instruments Thermal Analysis and Rheology to characterize the fluid's rheology. For rheology characterization, the rheometer is first calibrated per the manufacturers recommended methods using a specified tool; in this case, a 40 millimeter diameter stainless steel conical plate having a 2 degree slope.

After proper calibration, a small sample of the fluid is placed onto the instrument and the tool is placed at a specified gap between the tool and the measurement plate. The sample and the equipment are brought to temperature equilibrium at 25° C. Next, the rheometer measures the shear stress as the shear rate ramps up from 0.01 to 1.00 inverse seconds while recording 30 points per decade. The sample is held at a shear rate of 1 inverse second for a time of five seconds and the shear stress is measured each second for five seconds. Then, the rheometer measures the shear stress as the shear rate is ramped down from 1.00 to 0.01 inverse seconds while recording 30 points per decade.

The sample is allowed to rest for one minute to return to equilibrium. A shear at 0.25 inverse seconds is applied for five seconds. Next, the rheometer measures the shear stress as the shear rate ramps up from 0.25 to 150 inverse seconds while recording 30 points per decade. The sample is held at a shear rate of 150 inverse seconds for a time of five seconds and the shear stress is measured each second for five seconds. Then, the rheometer measures the shear stress as the shear rate ramps down from 150 to 0.25 inverse seconds while recording 30 points per decade.

The data collected by the rheometer may then be used to infer specific rheological parameters that can be correlated to consumer preferred gel automatic detergent composition rheology. One such set of parameters include the values of K and n. These values may be determined using the Power law equation.

Power Law Equation:

$$\text{Shear Stress}=\text{viscosity}*\text{Shear Rate}^{n}$$

The Power Law Equation is the simplest available method to predict the change in viscosity as a function of shear. Most non-Newtonian fluids may be described using this equation. The viscosity is replaced by a consistency coefficient, K. By definition, K will equal the viscosity at a shear rate of 1.0 inverse seconds. For shear thinning fluids, the index, n, will have a value less than 1. Values for K and n are commonly used to define the design requirements for equipment used in processing shear thinning fluids and may also be used to gauge the acceptance by consumers of a gel detergent.

A useful model for evaluating the yield stress of a shear thinning fluid is the Herschel-Bulkley equation, which is:

$$\text{Shear Stress}=\text{Yield Stress}+\text{viscosity}*\text{Shear Rate}^{n}$$

Using the TA Data Analysis software, the data collected from the rheometer can be evaluated to predict Yield Stress, K and n values. Yield stress is calculated using the Herschel-Bulkley equation to evaluate the data from the down curve from 0.04 to 0.01 inverse seconds shear rates. K and n values are calculated using the Power Law equation to evaluate the data from the down curve from 1.0 to 0.04 inverse seconds shear rates.

The viscosity of the gel automatic detergent composition is at 1 $sec^{-1}$ of from about 5,000 to about 40,000 centipoise; K of from about 9.0 to about 26.00 Pascal Sec; n less than 1.0; and yield stress greater than 2.0 Pascal.

In one embodiment, the liquid automatic detergent composition viscosity of the gel automatic detergent composition is at 1 $sec^{-1}$ of from about 9,000 to about 30,000 centipoise; Viscosity at 150 $sec^{-1}$ from about 100 to about 1000 centipoise; K of from about 15.0 to about 20.00 Pascal Sec; n less than 1.0; and yield stress greater than 2.0 Pascal.

In one embodiment, the gel automatic detergent composition viscosity of the gel automatic detergent composition is at 1 $sec^{-1}$ of from about 12,000 to about 25,000 centipoise; viscosity at 150 $sec^{-1}$ from about 450 to about 1,300 centipoise; K of from about 14.00 to about 26.00 Pascal Sec; n less than 1.0; and yield stress greater than 3.40 Pascal.

The detergent composition with which the method of the present invention may be utilized, further must contain from about 0.5% to about 80%, preferably 5% to 75%, and most preferably 7% to 65%, by weight of water. Of this total amount of water present in the detergent composition, a combination of free water and water of hydration may be present. The inclusion of water tends to lower the cost of making the compositions, decrease their flammability, and improve the dispersion of the components in the compositions. The level of water of hydration in the detergent composition varies depending upon the amount of hydrated components contained therein. For example, by increasing or decreasing the amount of hydrous silicate contained in the composition, the amount of water of hydration contained in said composition may be varied.

Method of Making

The ADW detergent composition herein is formed by the successive steps of: a) forming a solution premix comprising: i) water; ii) an alkali metal carbonate; iii) a dispersant polymer; and b) adding an alkali metal silicate to said solution premix.

Any specific equipment and mixing methods known in the art are suitable for combining the aforementioned components of the ADW detergent composition, provided that the aforementioned order-of-addition is adhered to.

It has been found that conventional methods of formulating nil-phosphate liquid detergent compositions, which contain an alkali metal carbonate, often result in crystal formation as the mixture cools. It is believed that adding an alkali metal silicate after the formation of the premix, creates an environment whereby silicate/silicate and silicate/carbonate formation occurs in a more repeatable and controlled fashion as compared to other mixing methods.

Upon formation of the solution premix, additional and minor ingredients may be added to the solution (ie. thickeners, surfactants, stabilizers, enzymes, etc.). Such additional and minor ingredients may be added to the solution premix prior to, or after the addition of the alkali metal silicate, provided that the order of addition of the aforementioned essential components is not disrupted.

In one embodiment, the solution premix is heated to from about 40° C. to about 75° C. Upon, or after adding the alkali metal silicate to the premix, the composition is cooled to from about 20° C. to about 30° C.

Alkali Carbonates

The present invention comprises at least one alkali metal carbonate. The alkali carbonates may include sodium and/or potassium carbonate. According to one embodiment of the invention, the alkali carbonate is comprised in quantities of up to 90 wt. %, preferably 50 to 75 wt. %, based on the total builder system. The advantage of these quantities is seen in relation to the required alkalinity of the detergent and/or cleanser and the washing liquor into which the composition is added.

Dispersant Polymer

The premix herein comprises a dispersant polymer typically in the range from 0.5 to about 25%, preferably from about 0.5% to about 20%, more preferably from about 1% to about 7% by weight of the gel automatic detergents.

One dispersant polymer suitable for use in the present composition includes an ethoxylated cationic diamine comprising the formula (III):

Formula (III)

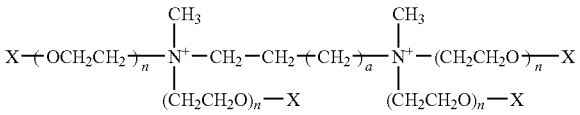

wherein X of formula (III) is a nonionic group selected from the group consisting of H, $C_1$-$C_4$ alkyl or hydroxyalkyl ester or ether groups, and mixtures thereof; n is at least about 6; and a is from 0 to 4 (e.g. ethylene, propylene, hexamethylene). For preferred ethoxylated cationic diamines, n of formula (III) is at least about 12 with a typical range of from about 12 to about 42. See U.S. Pat. No. 4,659,802 for further information regarding the ethoxylated cationic diamines.

Further suitable dispersant polymers suitable for use herein are illustrated by formula (IV)

Formula (IV)

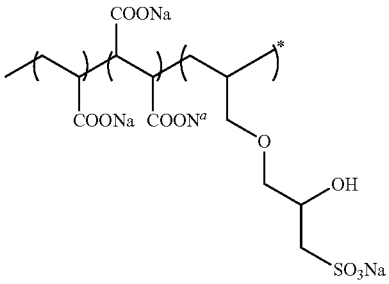

Formula IV is an Acrylic acid (AA), maleic acid (MA) and sodium 3-allyloxy-2-hydroxy-1-propanesulfonate (HAPS) copolymer, preferably comprising about 45 wt % by weight of the polymer of AA, about 45 wt % by weight of the polymer of MA and about 10 wt % by weight of the polymer of HAPS. Molecular weight may be from about 8000 to about 15000. In one embodiment, formula (IV) comprises a molecular weight of about 8000 to about 8500. In another embodiment formula (IV) comprises a molecular weight of about 12500 to about 13300. Salts of formula (IV) may be selected from any water soluble salt such as sodium or potassium salt.

Further suitable dispersant polymers suitable for use herein are illustrated by the film-forming polymers. Suitable for use as dispersants herein are co-polymers synthesized from acrylic acid, maleic acid and methacrylic acid such as ACUSOL® 480N supplied by Rohm & Haas and polymers containing both carboxylate and sulphonate monomers, such as ALCOSPERSE® polymers (supplied by Alco). In one embodiment an ALCOSPERSE® polymer sold under the trade name ALCOSPERSE® 725, is a co-polymer of Styrene and Acrylic Acid with the following structure shown in formula (IV):

Formula (V)

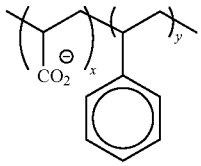

Wherein the x:y ratio of formula (V) is from about 60:40 or about 50:50 and the polymer having a molecular weight about 8000.

In certain embodiments, a dispersant polymer may be present in an amount in the range from about 0.01% to about 25%, or from about 0.1% to about 20%, and alternatively, from about 0.1% to about 7% by weight of the composition.

Further suitable dispersant polymers include polyacrylic phosphono end group polymers or acrylic-maleic phosphono end group copolymers for use herein are according to the general formula (V): $H_2PO_3$—($CH_2$—CHCOOH)n—(CHCOOH—CHCOOH)m- wherein n of formula (VI) is an integer greater than 0, m of formula (VI) is an integer of 0 (for polyacrylic polymers) or greater (for acrylic-maleic copolymers) and n and m of formula (VI) are integers independently selected to give a molecular weight of the polymer of between 500 and 200,000, preferably of between 500 and 100,000, and more preferably between 1,000 and 50,000. For polyacrylates, m of formula (VI) is zero. Suitable polyacrylic polymers or acrylic-maleic copolymers for use herein are available form Rohm &Haas under the tradenames ACUSOL® E 420 or 470 or 425. In one embodiment Acusol® 425N is utilized, Acusol® 425N is an acrylic-maleic (ratio 80/20) copolymer, having a molecular weight of 19,000, and is available from Rohm & Haas. Another suitable polyacrylate polymer is YS-100 which is commercially available from Nippon Shokubai Co. Ltd.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula (VII):—[(C($R^2$)C($R^1$)(C(O)O$R^3$))]— wherein the incomplete valencies inside the square braces of formula (VII) are hydrogen and at least one of the substituents $R^1$, $R^2$ or $R^3$ of formula (VII), preferably $R^1$ or $R^2$ of formula (VII), is a 1 to 4 carbon alkyl or hydroxyalkyl group, $R^1$ or R2 of formula (VII) can be a hydrogen and R3 of formula (VII) can be a hydrogen or alkali metal salt. Most preferred is a substituted acrylic monomer wherein R1 of formula (VII) is methyl, $R^2$ of formula (VII) is hydrogen and $R^3$ of formula (VII) is sodium.

Particularly preferred dispersant polymers include polymeric polycarboxylate, and/or copolymeric polycarboxylate. Such low molecular weight polyacrylate dispersant polymers preferably have a molecular weight of less than about 15,000, preferably from about 500 to about 10,000, most preferably from about 1,000 to about 5,000. The most preferred polyacrylate copolymer for use herein has a molecular weight of 1900 and is the fully neutralized form of the polymer comprising about 80% by weight acrylic acid and about 20% by weight maleic acid.

Corrosion Inhibitors

The formulations also include corrosion inhibitors, such as alkali metal silicates. Soluble silicates are highly effective corrosion inhibitors and can be added to certain formulas of this invention at levels of from about 0.5 to about 10 wt. %, particularly about 0.5 to about 3 wt. %, and most preferably from about 0.5 to about 2 wt. %. Such silicates are particularly effective against corrosion of metal and glass substrates during wash cycles.

Alkali metal silicates, preferably potassium or sodium silicates having a weight ratio of $SiO_2$:$M_2$ O of from about 1:1 to 2.8:1 can be used. M in this ratio refers to sodium or potassium. A sodium silicate having a ratio of $SiO_2$:$Na_2$ O of about 1.6:1 to 2.45:1 is especially preferred for economy and effectiveness.

Other corrosion inhibitors may include complex aluminates, zincates, or other inhibitors known in the art.

Non-Ionic Surfactants

The final composition includes at least one non-ionic surfactant. Suitable nonionic surfactants include, but are not limited to low-foaming nonionic (LFNI) surfactants. A LFNI surfactant is most typically used in an automatic dishwashing composition because of the improved water-sheeting action (especially from glassware) which they confer to the automatic dishwashing composition. They also may encompass non-silicone, phosphate or nonphosphate polymeric materials which are known to defoam food soils encountered in automatic dishwashing. The LFNI surfactant may have a relatively low cloud point and a high hydrophilic-lipophilic balance (HLB). Cloud points of 1% solutions in water are typically below about 32° C. and alternatively lower, e.g., 0° C., for optimum control of sudsing throughout a full range of water temperatures. If desired, a biodegradable LFNI surfactant having the above properties may be used.

A LFNI surfactant may include, but is not limited to: alkoxylated surfactants, especially ethoxylates derived from primary alcohols, and blends thereof with more sophisticated surfactants, such as the polyoxypropylene/polyoxyethylene/polyoxypropylene reverse block polymers. Suitable block polyoxyethylene-polyoxypropylene polymeric compounds that meet the requirements may include those based on ethylene glycol, propylene glycol, glycerol, trimethylolpropane and ethylenediamine, and mixtures thereof. Polymeric compounds made from a sequential ethoxylation and propoxylation of initiator compounds with a single reactive hydrogen atom, such as $C_{12-18}$ aliphatic alcohols, do not generally provide satisfactory suds control in Automatic dishwashing compositions. However, certain of the block polymer surfactant compounds designated as PLURONIC® and TETRONIC® by the BASF-Wyandotte Corp., Wyandotte, Mich., are suitable in Automatic dishwashing compositions.

The LFNI surfactant can optionally include a propylene oxide in an amount up to about 15% by weight. Other LFNI surfactants can be prepared by the processes described in U.S. Pat. No. 4,223,163. The LFNI surfactant may also be derived from a straight chain fatty alcohol containing from about 16 to about 20 carbon atoms ($C_{16}$-$C_{20}$ alcohol), alternatively a $C_{18}$ alcohol, condensed with an average of from about 6 to about 15 moles, or from about 7 to about 12 moles, and alternatively, from about 7 to about 9 moles of ethylene oxide per mole of alcohol. The ethoxylated nonionic surfactant so derived may have a narrow ethoxylate distribution relative to the average.

In certain embodiments, a LFNI surfactant having a cloud point below 30° C. may be present in an amount from about 0.01% to about 60%, or from about 0.5% to about 10% by weight, and alternatively, from about 1% to about 5% by weight of the composition Optional Adjunct Ingredients Any suitable adjunct ingredient in any suitable amount may be used in the ADW detergent composition. Suitable adjunct ingredients as described herein may be substantially sodium ion-free. Suitable adjunct ingredients may include, but are not limited to: co-surfactants; suds suppressors; builders; enzymes; bleaching systems; dispersant polymers; carrier media; thickeners and mixtures thereof.

Other suitable adjunct ingredients may include, but are not limited to: enzyme stabilizers, such as calcium ion, boric acid, propylene glycol, short chain carboxylic acids, boronic acids, and mixtures thereof; chelating agents, such as, alkali metal ethane 1-hydroxy diphosphonates (HEDP), alkylene poly (alkylene phosphonate), as well as, amino phosphonate compounds, including amino aminotri(methylene phosphonic acid) (ATMP), nitrilo trimethylene phosphonates (NTP), ethylene diamine tetra methylene phosphonates, and diethylene triamine penta methylene phosphonates (DTPMP); alkalinity sources; water softening agents; secondary solubility modifiers; soil release polymers; hydrotropes; binders; antibacterial actives, such as citric acid, benzoic acid, benzophenone, thymol, eugenol, menthol, geraniol, vertenone, eucalyptol, pinocarvone, cedrol, anethol, carvacrol, hinokitiol, berberine, ferulic acid, cinnamic acid, methyl salicylic acid, methyl salicylate, terpineol, limonene, and halide-containing compounds; detergent fillers, such as potassium sulfate; abrasives, such as, quartz, pumice, pumicite, titanium dioxide, silica sand, calcium carbonate, zirconium silicate, diatomaceous earth, whiting, and feldspar; anti-redeposition agents, such as organic phosphate; anti-oxidants; metal ion sequestrants; anti-tarnish agents, such as benzotriazole; anti-corrosion agents, such as, aluminum-, magnesium-, zinc-containing materials (e.g. hydrozincite and zinc oxide); processing aids; plasticizers, such as, propylene glycol, and glycerine; thickening agents, such as cross-linked polycarboxylate polymers with a weight-average molecular weight of at least about 500,000 (e.g. CARBOPOL® 980 from B. F. Goodrich), naturally occurring or synthetic clays, starches, celluloses, alginates, and natural gums, (e.g. xanthum gum); aesthetic enhancing agents, such as dyes, colorants, pigments, speckles, perfume, and oils; preservatives; and mixtures thereof. Suitable adjunct ingredients may contain low levels of sodium ions by way of impurities or contamination. In certain non-limiting embodiments, adjunct ingredients may be added during any step in the process in an amount from about 0.0001% to about 91.99%, by weight of the composition.

Adjunct ingredients suitable for use are disclosed, for example, in U.S. Pat. Nos.: 3,128,287; 3,159,581; 3,213,030; 3,308,067; 3,400,148; 3,422,021; 3,422,137; 3,629,121; 3,635,830; 3,835,163; 3,923,679;3,929,678; 3,985,669; 4,101,457; 4,102,903; 4,120,874; 4,141,841; 4,144,226; 4,158,635; 4,223,163; 4,228,042; 4,239,660; 4,246,612; 4,259,217; 4,260,529; 4,530,766; 4,566,984; 4,605,509; 4,663,071; 4,663,071; 4,810,410; 5,084,535; 5,114,611; 5,227,084; 5,559,089; 5,691,292; 5,698,046; 5,705,464; 5,798,326; 5,804,542; 5,962,386; 5,967,157; 5,972,040; 6,020,294; 6,113,655; 6,119,705; 6,143,707; 6,326,341; 6,326,341; 6,593,287; and 6,602,837; European Patent Nos.: 0,066,915; 0,200,263; 0332294; 0414 549; 0482807; and 0705324; PCT Pub. Nos.: WO 93/08876; and WO 93/08874.

Buffers/Electrolytes pH adjusting agents are added to adjust the pH, and/or buffers may act to maintain pH. In this instance, alkaline pH is favored for purposes of both rheology and cleaning effectiveness. Additionally, if the cleaner includes a hypochlorite source, a high pH is important for maintaining hypochlorite stability. Examples of buffers include, amino acids, tris(hydroxymethyl)amino methane (TRIS), 2-amino-2-ethyl-1,3-propanediol, 2-amino-2-methyl-propanol, 2-amino-2-methyl-1,3-propanol, potassium glutamate, N-methyl diethanolamide, 1,3-diamino-propanol N,N'-tetra-methyl-1,3-diamino-2-propanol, N,N-bis(2-hydroxyethyl)glycine(bicine), N-tris(hydroxymethyl)methyl glycine(tricine), potassium carbonate, potassium polyphosphate, and organic diamines, alkali metal silicates, metasilicates, polysilicates, carbonates, bicarbonates, sesquicarbonates, hydroxides, orthophosphates, metaphosphates, pyrophosphates, polyphosphates and mixtures of the same. Certain organicbuffers also appear suitable (although may require an additional ionizable compound), such as polyacrylates, and the like. Control of pH may be necessary to maintain the stability of a hypochlorite source and to avoid protonating the amine oxide.

Where the active halogen source is sodium hypochlorite, the pH is maintained above about pH 10.5, preferably above or about pH 12. Most preferred for this purpose are the alkali metal hydroxides, especially sodium, potassium, or lithium hydroxide. The total amount of pH adjusting agent/buffer including that inherently present with bleach plus any added, can vary from about 0.1% to 15%, preferably from about 0.1-10%.

Co-surfactants

Any suitable co-surfactant in any suitable amount or form may be used herein. Suitable co-surfactants include anionic surfactants, cationic surfactants, nonionic surfactants, amphoteric surfactants, ampholytic surfactants, zwitterionic surfactants, and mixtures thereof. For example, a co-surfactant may be used in a surfactant system or mixed surfactant system comprising two or more distinct surfactants (such as, a charged co-surfactant selected from nonionic surfactants, zwitterionic surfactants, anionic surfactants, and mixtures thereof). The zwitterionic surfactant may be chosen from the group consisting of $C_8$ to $C_{18}$ (alternatively, $C_{12}$ to $C_{18}$) amine oxides and sulfo- and hydroxy-betaines, such as N-alkyl-N, N-dimethylammino-1-propane sulfonate where the alkyl group can be $C_8$ to $C_{18}$, alternatively $C_{10}$ to $C_{14}$. The anionic surfactant may be chosen from alkylethoxycarboxylates, alkylethoxysulfates, with the degree of ethoxylation greater than 3 (alternatively from about 4 to about 10, or from about 6 to about 8), and chain length in the range of $C_8$ to $C_{16}$, alternatively in the range of $C_{11}$ to $C_{15}$.

Additionally, branched alkylcarboxylates have been found to be useful when the branch occurs in the middle and the average total chain length may be 10 to 18, alternatively 12-16 with the side branch 2-4 carbons in length. An example is 2-butyloctanoic acid. The anionic surfactant may be typically of a type having good solubility in the presence of calcium. Such anionic surfactants are further illustrated by sulfobetaines, alkyl(polyethoxy)sulfates (AES), alkyl(polyethoxy) carboxylates (AEC), and short-chained $C_6$-$C_{10}$ alkyl sulfates and sulfonates.

Co-surfactants suitable for use are disclosed, for example, in U.S. Pat. Nos. 3,929,678; 4,223,163; 4,228,042; 4,239,660; 4,259,217; 4,260,529; and U.S. Pat. No. 6,326,341; EP Pat. No. 0414 549, EP Pat. No. 0,200,263, PCT Pub. No. WO 93/08876 and PCT Pub. No. WO 93/08874.

Suds Suppressor

Any suitable suds suppressor in any suitable amount or form may be used herein. Suds suppressors suitable for use may be low-foaming and include low cloud point nonionic surfactants (as discussed above) and mixtures of higher foaming surfactants with low cloud point nonionic surfactants which act as suds suppressors therein (see EP Pat. No. 0705324, U.S. Pat. Nos. 6,593,287, and 6,326,341). In certain embodiments, one or more suds suppressors may be present in an amount from about 0% to about 30% by weight, or about 0.2% to about 30% by weight, or from about 0.5% to about 10%, and alternatively, from about 1% to about 5% by weight of composition.

Builders

Any suitable phosphate-free builder in any suitable amount or form may be used herein. Suitable builders may include citrates, aluminosilicates, silicates, polycarboxylates, fatty acids, such as ethylene-diamine tetraacetate, metal ion sequestrants such as aminopolyphosphonates, ethylenediamine tetramethylene phosphonic acid, and diethylene triamine pentamethylene-phosphonic acid, and mixtures thereof.

Examples of other suitable phosphate-free builders are disclosed in the following patents and publications: U.S. Pat. Nos. 3,128,287; 3,159,581; 3,213,030; 3,308,067; 3,400,148; 3,422,021; 3,422,137; 3,635,830; 3,835,163; 3,923,679; 3,985,669; 4,102,903; 4,120,874; 4,144,226; 4,158,635; 4,566,984; 4,605,509; 4,663,071; and U.S. Pat. No. 4,663,071; German Patent Application No. 2,321,001 published on Nov. 15, 1973; European Pat. No. 0,200,263; Kirk Othmer, 3rd Edition, Vol. 17, pp. 426-472 and in "Advanced Inorganic Chemistry" by Cotton and Wilkinson, pp. 394-400 (John Wiley and Sons, Inc.; 1972).

Enzyme

Any suitable enzyme and/or enzyme stabilizing system in any suitable amount or form may be used herein. Enzymes suitable for use include, but are not limited to: proteases, amylases, lipases, cellulases, peroxidases, and mixtures thereof. Amylases and/or proteases are commercially available with improved bleach compatibility.

Suitable proteolytic enzymes include, but are not limited to: trypsin, subtilisin, chymotrypsin and elastase-type proteases. Suitable for use herein are subtilisin-type proteolytic enzymes. Particularly preferred is bacterial serine proteolytic enzyme obtained from *Bacillus subtilis* and/or *Bacillus licheniformis*. Suitable proteolytic enzymes also include Novo Industri A/S ALCALASE®, ESPERASE®, SAVINASE® (Copenhagen, Denmark), Gist-brocades' MAX- ATASE®, MAXACAL® and MAXAPEM® 15 (protein engineered MAXACAL®) (Delft, Netherlands), and subtilisin BPN and BPN'(preferred), which are commercially available. Suitable proteolytic enzymes may include also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International), which is called "Protease A" herein (same as BPN'). In particular see columns 2 and 3 of U.S. Pat. No. 5,030,378 for a complete description, including amino sequence, of Protease A and its variants. Other proteases are sold under the tradenames: PRIMASE®, DURAZYM®, OPTICLEAN® and OPTIMASE®. In one non-limiting embodiment, a suitable proteolytic enzyme may be selected from the group consisting of ALCALASE® (Novo Industri A/S), BPN', Protease A and Protease B (Genencor), and mixtures thereof.

In practical terms, the ADW detergent composition may comprise an amount up to about 5 mg, more typically about 0.01 mg to about 3 mg by weight, of active enzyme per gram of the composition. Protease enzymes may be provided as a commercial preparation at levels sufficient to provide from 0.005 to 0.1 Anson units (AU) of activity per gram of composition, or 0.01%-1% by weight of the enzyme preparation. For ADW purposes, it may be desirable to increase the active enzyme content in order to reduce the total amount of non-catalytically active materials delivered and thereby improve anti-spotting/anti-filming results. Examples of suitable enzymes are disclosed in the following patents and publications: U.S. Pat. Nos. 4,101,457; 5,559,089; 5,691,292; 5,698,046; 5,705,464; 5,798,326; 5,804,542; 5,962,386; 5,967,157; 5,972,040; 6,020,294; 6,113,655; 6,119,705; 6,143,707; and U.S. Pat. No. 6,602,837.

In certain embodiments, enzyme-containing ADW detergent compositions, especially liquids, liquigels, and gels, may comprise from about 0.0001% to about 10%, or from about 0.005% to 8%, or from about 0.01% to about 6%, by weight of an enzyme stabilizing system. The enzyme stabilizing system can include any stabilizing agent that is compatible with the detersive enzyme. Suitable enzyme stabilizing agents can include, but are not limited to: calcium ions, boric acid, glycerine, propylene glycol, short chain carboxylic acid, boronic acid, and mixtures thereof.

Bleaching System

Any suitable bleaching system comprising any suitable bleaching agent in any suitable amount or form may be used herein. Suitable bleaching agents include, but are not limited to: halogenated bleaches and oxygen bleaches.

Any suitable oxygen bleach may be used herein. Suitable oxygen bleaches can be any convenient conventional oxygen bleach, including hydrogen peroxide. For example, perborate, e.g., sodium perborate (any hydrate, e.g. mono- or tetrahydrate), potassium perborate, sodium percarbonate, potassium percarbonate, sodium peroxyhydrate, potassium peroxyhydrate, sodium pyrophosphate peroxyhydrate, potassium pyrophosphate peroxyhydrate, sodium peroxide, potassium peroxide, or urea peroxyhydrate can be used herein. Organic peroxy compounds can also be used as oxygen bleaches. Examples of these are benzoyl peroxide and the diacyl peroxides. Mixtures of any convenient oxygen bleaching sources can also be used.

Any suitable halogenated bleach may be used herein. Suitable halogenated bleaches may include chlorine bleaches. Suitable chlorine bleaches can be any convenient conventional chlorine bleach. Such compounds are often divided in to two categories namely, inorganic chlorine bleaches and organic chlorine bleaches. Examples of the former are sodium hypochlorite, calcium hypochlorite, potassium hypochlorite, magnesium hypochlorite and chlorinated trisodium phosphate dodecahydrate. Examples of the latter are potassium dichloroisocyanurate, sodium dichloroisocyanurate, 1,3-dichloro-5,5-dimethlhydantoin, N-chlorosulfamide, chloramine T, dichloramine T, chloramine B, dichloramine T, N,N'-dichlorobenzoylene urea, paratoluene sulfondichoroamide, trichloromethylamine, N-chlorosuccinimide, N,N'-dichloroazodicarbonamide, N-chloroacetyl urea, N,N'-dichlorobiuret and chlorinated dicyandamide.

The bleaching system may also comprise transition metal-containing bleach catalysts, bleach activators, and mixtures thereof. Bleach catalysts suitable for use include, but are not limited to: the manganese triazacyclononane and related complexes (see U.S. Pat. No. 4,246,612, U.S. Pat. No. 5,227,084); Co, Cu, Mn and Fe bispyridylamine and related complexes (see U.S. Pat. No. 5,114,611); and pentamine acetate cobalt (III) and related complexes (see U.S. Pat. No. 4,810,410) at levels from 0% to about 10.0%, by weight; and alternatively, from about 0.0001% to about 1.0%.

Typical bleach activators suitable for use include, but are not limited to: peroxyacid bleach precursors, precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP Pat. No. 0170386); and benzoxazin peroxyacid precursors (EP Pat. No. 0332294 and EP Pat. No. 0482807) at levels from 0% to about 10.0%, by weight; or from about 0.1% to about 1.0%.

In certain embodiments, the bleaching agent, bleach catalyst, and/or bleach activator may be encapsulated with any suitable encapsulant that is compatible with the aqueous ADW detergent composition and any bleach-sensitive adjunct ingredient (e.g. enzymes). For example, sulfate/carbonate coatings may be provided to control the rate of release as disclosed in UK Pat. No. GB 1466799.

Examples of suitable bleaching agents and bleaching systems may be disclosed in the following publications: GB-A-836988, GB-A-855735, GB-A-864798, GB-A-1147871, GB-A-1586789, GB-A-1246338, and GB-A-2143231. In other embodiments, the bleaching agent or bleaching system may be present in an amount from about 0% to about 30% by weight, or about 1% to about 15% by weight, or from about 1% to about 10% by weight, and alternatively from about 2% to about 6% by weight of composition.

Polyvalent Metals

The present compositions may also comprise polyvalent metal compounds, such as salts, inorganic salts, oxides and mixtures thereof.

Suitable polyvalent metal compounds include aluminum acetate, aluminum ammonium sulfate, aluminum chlorate, aluminum chloride, aluminum chlorohydrate, aluminum diformate, aluminum fluoride, aluminum formoacetate, aluminum hydroxide, aluminum lactate, aluminum laurate, aluminum metaphosphate, aluminum monostearate, aluminum monostearate, aluminum nitrate, aluminum oleate, aluminum oxide, aluminum oxylate, aluminum palmitate, aluminum phosphate, aluminum potassium sulfate, aluminum resinate, aluminum salicylate, aluminum silicates, aluminum sodium sulfate, aluminum stearate,aluminum sulfate, aluminum tartrate, aluminum triformate, basic zinc carbonate, hydrozincite, magnesium acetate, magnesium acetylacetonate, magnesium aluminate, magnesium ammonium phosphate, magnesium benzoate, magnesium biophosphate, magnesium borate, magnesium borocitrate, magnesium bromate, magnesium bromide, magnesium calcium chloride, magnesium chlorate, magnesium chloride, magnesium chromate, magnesium citrate, magnesium dichromate, magnesium fluoride, magnesium fluosilicate, magnesium formate, magnesium gluconate, magnesium glycerophosphate, magnesium hydroxide, magnesium lauryl sulfate, magnesium nitrate, magnesium oleate, magnesium oxide, magnesium perborate, magnesium perchlorate, magnesium permanganate, magnesium phosphate dibasic, magnesium phosphate monobasic, magnesium phosphate tribasic, magnesium pyrophosphate, magnesium salicylate, magnesium silicate, magnesium stannate, magnesium stannide, magnesium sulfate, magnesium sulfide, magnesium sulfite, magnesium trisilicate, zinc acetate, zinc bacitracin, zinc benzoate, zinc borate, zinc bromate, zinc bromide, zinc carbonate, zinc chlorate, zinc chloride, zinc ethysulfate, zinc fluorosilicate, zinc formate, zinc gluconate, zinc hydrosulfite, zinc hydroxide, zinc lactate, zinc laurate, zinc linoleate, zinc malate, zinc nitrate, zinc oxide, zinc perborate, zinc phosphate, zinc salicylate, zinc silicate, zinc stearate, zinc sulfamate, zinc sulfate, zinc sulfide, zinc sulfite, zinc tartrate, and mixtures thereof.

Product Form

The liquid ADW detergent composition may be provided in the form of a kit, wherein said kit comprises a package comprising: (a) the liquid ADW composition described herein, and (b) instructions for use of said composition to treat glassware and/or metal and reduce glassware and/or metal surface corrosion in an automatic dishwashing appliance.

The liquid ADW detergent composition may also be provided in the form of a unit dose pouch. Water-soluble liquid-encapsulated unit dose pouches are generally known in the art, and a suitable for delivery of the present compositions. Examples of such unit dose pouches include capsules, tablets, multi-phase tablets, coated tablets, single-compartment water-soluble pouches, multi-compartment water-soluble pouches, and combinations thereof; and the composition may be in at least one or more of the following forms: liquids, liquigels, gels, foams, creams, and pastes.

EXAMPLES

The following examples of ADW detergent compositions are provided for purposes of showing certain embodiments, and as such are not intended to be limiting in any manner. The examples demonstrate liquid ADW detergent compositions which may be formed using the premix described herein.

| | EXAMPLES | | | | |
|---|---|---|---|---|---|
| Ingredients | 1 | 2 | 3 | 4 | 5 |
| Sodium carbonate | 11.0 | 11.50 | 11.68 | 11.79 | 11.55 |
| Sodium Sulfate | — | 6.00 | — | — | 6.63 |
| Sodium silicate | 7.8 | 7.8 | 4.2 | 4.3 | — |
| Zinc Carbonate AC | 0.1 | 0.1 | 0.1 | — | — |
| LFNI surfactant[1] | 8 | 10 | 8 | 8 | 10 |
| Dispersant polymer[2] | 7.00 | 6.25 | 6.15 | 6.78 | 6.20 |
| Sodium hypochlorite | — | — | — | 1.1 | — |
| Sodium perborate | 12.8 | 12.8 | 9.3 | — | — |
| Catalyst/activator[3] | 0.013 | 0.013 | 0.013 | — | — |

-continued

| | EXAMPLES | | | | |
|---|---|---|---|---|---|
| Ingredients | 1 | 2 | 3 | 4 | 5 |
| Protease enzyme | 2.2 | 2.2 | 0.3 | — | 1.3 |
| Amylase enzyme | 1.7 | 1.7 | 0.9 | — | 0.2 |
| Aesthetic enhancing agents/Fillers/Water | Balance | Balance | Balance | Balance | Balance |

[1]POLY-TERGENT ® SLF-18B available from Olin Corporation
[2]Acusol ® 425N - available from Rohm & Haas
[3]Pentamine acetate cobalt (III)/sodium nonanoyloxybenzene sulfonate With reference to the polymers described herein, the term weight-average molecular weight is the weight-average molecular weight as determined using gel permeation chromatography according to the protocol found in Colloids and Surfaces, Physico Chemical & Engineering Aspects, Vol. 162, 2000, pg. 107-121. The units are Daltons.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

It should be understood that every maximum numerical limitation given throughout this specification would include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and other values disclosed herein are not to be understood as being strictly limited to the exact numerical values recited. Instead, unless otherwise specified, each such value is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid ADW detergent composition consisting essentially of:

a) an alkali metal carbonate;

b) a dispersant polymer;

c) from about 0.5 wt. % to about 3.0 wt. % of an alkali metal silicate;

d) a low-foaming non-ionic surfactant; and e) water;

wherein said composition exhibits a viscosity of from about 5,000 Cps—about 40,000 Cps, and wherein said composition is substantially free of a phosphate builder.

2. A method of making a liquid ADW detergent composition comprising the successive steps of:

a) forming a solution premix comprising:

i) water;

ii) an alkali metal carbonate;

iii) a dispersant polymer; and b) adding an alkali metal silicate to said solution premix;

wherein said composition comprises a low-foaming non-ionic surfactant and wherein said composition is free of a phosphate builder.

3. An ADW detergent composition formed according to the method of claim 2.

4. A method according to claim 2, further comprising the step of heating said premix to a temperature of from about 40° C. to about 75° C.

5. A method according to claim 4, further comprising the step of cooling said liquid ADW detergent composition to from about 20° C. to about 30° C.

6. The method according to claim 2 wherein said detergent composition comprises an adjunct ingredient selected from the group consisting of: co-surfactants, suds suppressors, builders, sequestrants, bleaching agents, bleach activators, bleach catalysts, enzymes, enzyme stabilizers, thickening agents, chelating agents, alkalinity sources, pH buffering agents, water softening agents, secondary solubility modifiers, soil release polymers, dispersant polymers, hydrotropes, fillers, binders, carrier mediums, oils, organic solvents, anti-bacterial actives, abrasives, anti-redeposition agents, anti-tarnish agents, anti-corrosion agents, processing aids, plasticizers, aesthetic enhancing agents, preservatives, and mixtures thereof.

7. The method according to claim 6 comprising a builder selected from the group consisting of citrates, aluminosilicates, silicates, polycarboxylates, fatty acids, metal ion sequestrants, and mixtures thereof.

8. The liquid ADW composition according to claims 3, wherein said dispersant polymer is a polymeric polycarboxylate, and/or copolymeric polycarboxylate.

9. The liquid ADW composition according to claim 3, wherein said alkali metal silicate is comprised in an amount of from about 0.5 to about 3 wt. %.

10. The liquid ADW detergent composition wherein said composition is provided in the form of a kit, wherein said kit comprises a package comprising: (a) said composition according to claim 3, and (b) instructions for use of said composition to treat glassware and reduce glassware surface corrosion in an automatic dishwashing appliance.

11. The liquid ADW composition according to claim 3, wherein said composition is provided in the form of a unit dose selected from the group consisting of capsules, tablets, multi-phase tablets, coated tablets, single-compartment water-soluble pouches, multi-compartment water-soluble pouches, and combinations thereof; and wherein said composition is in at least one or more of the following forms: liquids, liquigels, gels, foams, creams, and pastes.

* * * * *